United States Patent [19]

Mori et al.

[11] Patent Number: 4,628,837

[45] Date of Patent: Dec. 16, 1986

[54] METHOD AND APPARATUS FOR PROCESSING SPENT ION EXCHANGE RESIN

[75] Inventors: Kazuhide Mori; Shin Tamata; Makoto Kikuchi; Masami Matsuda, all of Hitachi; Yoshiyuki Aoyama, Kawasaki, all of Japan

[73] Assignee: Hitachi, Ltd., Tokyo, Japan

[21] Appl. No.: 677,992

[22] Filed: Dec. 4, 1984

[30] Foreign Application Priority Data

Dec. 9, 1983 [JP] Japan ..... 58-232478

[51] Int. Cl.[4] ..... F23G 7/00

[52] U.S. Cl. ..... 110/346; 110/210; 110/245

[58] Field of Search ..... 110/208, 210, 211, 212, 110/214, 219, 224, 225, 235, 237, 238, 346, 245

[56] References Cited

U.S. PATENT DOCUMENTS

| | | | |
|---|---|---|---|
| 3,541,066 | 3/1976 | Itoh et al. | 110/346 |
| 3,848,548 | 11/1974 | Bolejack, Jr. et al. | 110/212 X |
| 4,091,747 | 5/1978 | Chase | 110/210 |
| 4,182,246 | 1/1980 | Lombana et al. | 110/225 X |
| 4,277,362 | 7/1981 | Mallek et al. | 110/238 X |
| 4,331,630 | 5/1982 | Van Pool | 110/212 X |
| 4,347,225 | 8/1982 | Audeh et al. | 110/346 X |
| 4,402,274 | 9/1983 | Meenan et al. | 110/346 |

FOREIGN PATENT DOCUMENTS 12400 1/1982 Japan .

*Primary Examiner*—Albert J. Makay
*Assistant Examiner*—Steven E. Warner
*Attorney, Agent, or Firm*—Beall Law Offices

[57] ABSTRACT

In a method of processing radioactive spent ion exchange resin, the spent ion exchange resin is pyrolyzed in an inert atmosphere and harmful decomposition gas such as sulfur and nitrogen compounds generated during pyrolysis is separated. Next, the spent ion exchange resin is pyrolyzed in oxidizing atmosphere and harmless gases such as carbon dioxide and water vapor gases are separated. It is preferred that a transition metal as a catalyst be adsorbed through ion exchange into spent cation exchange resin, and an anionic atom group containing a transition metal as a catalyst be adsorbed through ion exchange into spent anion exchange, before both of the pyrolysis steps. The pyrolysis is carried out at two atmosphere stages, and the harmful and harmless gases are decomposed separately. The pyrolysis in both of pyrolysis steps is effected at a temperature in the range of from 240° to 420° C. The proportions of the sulfur and nitrogen compounds in spent ion exchange resin after pyrolysis, and also the processing volume of the spent ion exchange resin can be reduced. And scattering of radioactive substances can be prevented. By adding a catalyst to the spent ion exchange resin, pyrolysis is carried out at a low temperature.

15 Claims, 9 Drawing Figures

METHOD AND APPARATUS FOR PROCESSING SPENT ION EXCHANGE RESIN

BACKGROUND OF THE INVENTION

This invention relates to a method and apparatus for processing a spent ion exchange resin, particularly a radioactive spent ion exchange resin generated in a nuclear power plant or the like.

The methods of reducing the volume of the spent ion exchange resin (waste resin) and converting it into inorganic matters can be broadly classified into a wet process typified by an acid decomposition method and a pyrolytic drying process typified by a fluidized bed method.

The wet process involves a problem in that after the waste resin is subjected to a decomposition treatment, a radioactive waste liquor containing decomposition residues must be again processed by any suitable means such as concentration by evaporation.

A fluidized bed method is a typical example of the dry process, wherein the waste resin is burnt by use of a fluidized bed, as illustrated in Japanese Patent Laid-Open No. 12400/1982, for example.

Though the dry process is free from the problems of the wet process, the following problems are encountered when the fluidized bed method as a typical example of the dry process is employed.

(1) The scattering quantity of the residue and ratioactive substances is great. In other words, since the waste resin is dispersed and burnt under a flowing gas, the residue and radioactive substances are entrained by the decomposition gas (exhaust gas) and scattered. Therefore, the load to a filter for processing the exhaust gas becomes great.

(2) When the waste resin is burnt, harmful decomposition gases such as oxide gases ($SO_x$), ($NO_x$) and the like are generated. For this reason, exhaust gas processing by means of an alkali scrubber or the like becomes necessary, but the quantity of the exhaust gas to be processed is enormous. In other words, in accordance with the fluidized bed method, air containing oxygen from three to five times the chemical equivalent must be supplied, and hence the quantity of the exhaust gas is increased so much.

(3) Not only the residue but also the secondary waste generated as a result of processing the exhaust gas, such as $NaNO_3$ and $Na_2SO_4$, incorporate into the radioactive substances of radioactive nuclides. And these are added to the radioactive wastes, thereby reducing the volume reduction ratio.

In other words, when 1 kg of the waste resin is burnt in the fluidized bed, the decomposition residue reaches several percents (about 3 g) and at the same time, about 0.7 kg of radioactive waste is generated. If this waste is subjected to volume reduction and is pelletized by the existing equipment for processing the radioactive waste, the volume reduction ratio is nothing but $\frac{1}{4}$.

$H_2O$ and $CO_2$ are also generated as the radioactive waste in quantities of 0.4 kg and 2.3 kg, respectively. If the quantity of the residue generated is 0.03 kg, the content of the sulfur and nitrogen compounds contained in the secondary radioactive waste generated by pyrolysis of the waste resin is 18 wt %.

When 1 kg of the cation exchange resin alone is pyrolyzed as the waste resin, the content described above is 24 wt %, and when 1 kg of the anion exchange resin alone is pyrolyzed, the content is 9 wt %. In other words, the content becomes worst when the cation exchange resin alone is pyrolyzed and the value is as great as 24 wt %. The reduction of secondary radioactive waste is desirable further carried out from the aspect of the reduction of the generation quantity of the radioactive waste.

(4) Since combustion is effected in single stage of the oxidizing atmosphere at a pyrolyzing temperature in the range of from 600° to 900° C., the furnace material will be deteriorated during use for an extended period.

(5) The problem common to the conventional techniques of reducing the volume of the waste resin and converting it into the inorganic matters is that the system for said conversion and that for solidifying the decomposition residue are separate from each other, so that the systems become complicated and the operators or workers are likely to be exposed to the radioactivity in the handling of the waste resin.

SUMMARY OF THE INVENTION

An object of the present invention is to provide a method and apparatus for processing spent ion exchange resin wherein the decomposition gas generated during pyrolysis of the spent ion exchange resin can be selectively separated and processed.

Another object of the present invention is to provide a method and apparatus for processing spent ion exchange resin wherein the processing volume of the spent ion exchange resin can be drastically reduced.

Another object of the present invention is to provide a method and apparatus for processing spent ion exchange resin wherein the proportions of the sulfur and nitrogen compounds in radioactive waste afte pyrolysis can be reduced.

Another object of the present invention is to provide a method and apparatus for processing spent ion exchange resin wherein scattering of the residue and radioactive substances can be prevented.

Another object of the present invention is to provide a method and apparatus for processing spent ion exchange resin wherein the spent ion exchange resin can be pyrolyzed at a low temperature.

The present invention resides in a method of processing a spent ion exchange resin which comprises first separating step of pyrolyzing a spent ion exchange resin in an inert atmosphere and separating the decomposition gas generated during pyrolysis, and second separating step of pyrolyzing the spent ion exchange resin which has passed through the first separating step in an oxidizing atmosphere and separating the decomposition gas generated during pyrolysis.

In order to practice the processing method described above, it is preferred that a transition metal as a catalyst be adsorbed in advance through ion exchange by the spent ion exchange resin when it is a spent cation exchange resin, and an anionic atom group containing a transition metal as a catalyst be adsorbed in advance through ion exchange by the spent ion exchange resin when it is a spent anion exchange resin, before both of the first and second separating steps are carried out.

Suitable examples of the transition metal to be adsorbed by the spent cation exchange resin are transition metals of the Group VIII of the Periodic Table typified by platinum, palladium and iron, or those of the Group I of the Periodic Table typified by copper.

Suitable examples of the anionic atom group containing the transition metal to be adsorbed by the spent anion exchange resin are one containing the transition metals of the Group VIII of the Periodic Table typified by chloroplatinic acid, chloropalladic acid and hexacyanoferric (III) acid, or one containing the transition metals of the Group VIII of the Periodic Table typified by permanganic acid.

Preferably, the pyrolysis in both of the first and second separating steps is effected at a temperature in the range of from 240° to 420° C.

The present invention resides in an apparatus for practising the processing method described above which comprises a reservoir for a spent ion exchange resin; a reservoir for an aqueous solution of a transition metal ion; a reservoir for an aqueous solution of an anionic atom group containing the transition metal; an adjustment tank for receiving contents of these reservoirs, and allowing a cation exchange resin among the spent ion exchange resin to adsorb the transition metal and an anion exchange resin to adsorb the anionic atom group through ion exchange; a reaction vessel for receiving the spent ion exchange resin which has passed through the adjustment tank, and pyrolyzing it in an inert atmosphere as the first stage reaction and in an oxidizing atmosphere as the second stage reaction; an exhaust gas processing means for processing sulfur oxide and nitrogen oxide gases generated at the first stage with an aqueous alkali solution; and an exhaust gas processing means for processing the carbon dioxide and water vapor gases generated at the second stage.

In the processing apparatus, the reaction vessel may be a single fixed bed reaction vessel which is equipped with an atmosphere replacing conduit for replacing the atmosphere and a gas discharge conduit for selectively communicating with each of the exhaust gas processing means. Alternatively, the reaction vessel may comprise individual moving bed reaction vessels for each of the first and second stage reactions, that are connected to each other, each being equipped therein with conduits for providing an inert atmosphere and an oxidizing atmosphere and with a conduit selectively communication with each of the exhaust gas processing means.

The principle of the present invention will now be described.

Ion exchange resins are polymer backbone of aromatic organic polymers having a structure generally composed of a copolymer between styrene and divinylbenzene (D.V.B.) as the backbone. A sulfonic acid group is bound to the backbone in the case of the cation exchange resin, while a quaternary ammonium group is bound to the backbone in the case of the anion exchange resin. The mechanism of pyrolysis of these ion exchange resins reveal that the pyrolysis of the ion exchange group is a thermal elimination reaction requiring no oxygen, whereas the pyrolysis of the polymer backbone is an oxidation reaction requiring oxygen.

The present invention is based on this finding and its gist is to carry out pyrolysis at the first stage in an inert atmosphere so as to selectively decompose only the ion exchange group, and then completely pyrolyze the polymer backbone at a subsequent stage in an oxidizing atmosphere.

The decomposition gases generated in this manner are separated at both the former and latter stages. This procedure makes it possible to generate sulfur oxide gas ($SO_x$) and nitrogen oxide gas ($NO_x$), that require careful exhaust gas processing, only at the former stage, and to generate carbon dioxide gas ($CO_2$) and water vapor gas ($H_2O$), that hardly require any exhaust gas processing, only at the latter stage. The quantities of the gases to be processed can be drastically reduced, and the residue can be converted into stable inorganic compounds.

If a transition metal as a catalyst is ionically adsorbed by such an ion exchange resin, the ion exchange resin group can be pyrolyzed at 130° to 300° C. and the polymer backbone (copolymer of styrene with D.V.B.) at 240° to 300° C. Thus, the use of the catalyst not only lowers the pyrolysis temperature, but also facilitates the selection of furnace materials and prevents the degradation of the furnace materials.

If the waste resin is pyrolyzed in a static atmosphere or close thereto, scattering of the residue and radioactive substances can be prevented, and radioactive nuclides are not retrained by exhaust gas, thus the load onto a filter for processing the exhaust gas can be remarkably reduced. Particularly when the pyrolysis is effected at a temperature below 420° C., scattering of volatile radioactive nuclides such as $^{137}Cs$ can be completely prevented. Therefore, the wastes such as $Na_2SO_4$ and the like that are generated as a result of processing of $NO_x$ and $SO_x$ exhaust gases can be regarded as being non-radioactive, because of no retraining radioactive nuclides. And the radioactive waste left after processing is only the residue, so that the quantity of the radioactive waste after the pyrolysis can be drastically reduced to about 1/20.

Since the pyrolysis of the waste resin and the solidification of the decomposition residue can be carried out in the same vessel, the transportation of a container from a pyrolysis apparatus to a solidification apparatus is not necessary, and counter-measures for the radioactivity during transportation becomes also unnecessary. Since the substance that would be contaminated with the radioactivity can thus be reduced, maintenance becomes easier, and the exposure of the worker can be reduced eventually.

The results of study for the principle of the present invention will be described in turn as following.

(1) Ion exchange resin and decomposition gas thereof.

Ion exchange resins can be classified into cation exchange resins that adsorb cationic elements and anion exchange resins that adsorb anionic elements.

The cation exchange resin has a cross-linked structure wherein a copolymer of styrene

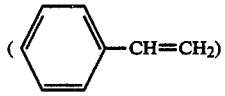

and divinylbenzene

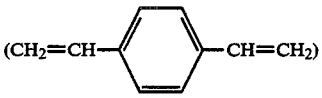

is used as a polymer backbone and a sulfonic acid group ($SO_3H$) as an ion exchange group is bound to the polymer backbone. It has a three-dimensional structure represented by the following structural formula, and its molecular formula is $(C_{16}H_{15}O_3S)_n$:

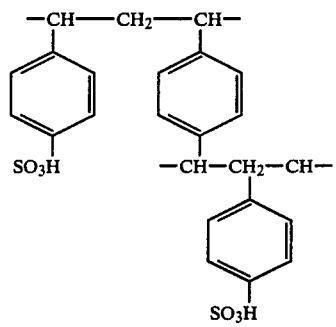

On the other hand, the anion exchange resin has a structure in which a quaternary ammionium group ($NR_3OH$) as the ion exchange group is bound to the same polymer backbone as that of the cation exchange resin. It has the following structural formula, and its molecular formula is $(C_{20}H_{26}ON)_n$:

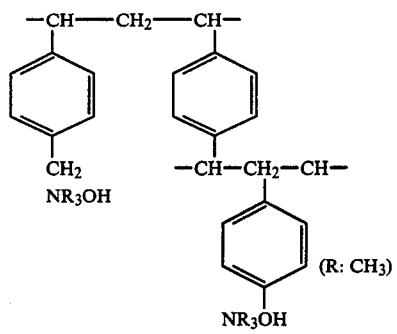

When the waste resins having such molecular structures are decomposed, the polymer backbone generates decomposition gases such as $CO_2$ and $H_2$ because it is composed of carbon and hydrogen, while the ion exchange group generates decomposition gases such as $SO_x$ and $NO_x$ because it is composed of sulfur or nitrogen. Among them, $CO_2$ and $H_2$ resulting from the decomposition of the polymer backbone does not require any particular exhaust gas processing, but $SO_x$ and $NO_x$ generated by the decomposition of the ion exchange group can not be discarded directly into the air since they are detrimental. Therefore, exhaust gas processing must be carefully carried out by an alkali scrubber or the like for $SO_x$ and $NO_x$ in order to carry out the reaction of next formula and to recover them as the solid such as $Na_2SO_4$, $NaNO_3$, and the like.

$$SO_x + NaOH \rightarrow Na_2SO_4 + H_2O$$

$$NO_x + NaOH \rightarrow NaNO_3 + H_2O$$

(2) Pyrolysis characteristics of ion exchange resin.

FIG. 1 shows the pyrolysis characteristics of the waste resin in the air (in oxidizing atmosphere or active atmosphere) when determined with a differential thermobalance, though the weight reduction due to the evaporation of water that occurs at 70° to 110° C. is not shown. A solid line (a) represents the characteristics of the anion exchange resin, and a broken line (b) that of the cation exchange resin. The quaternary ammonium group as the ion exchange group is first decomposed at 130°~190° C. in the anion exchange resin, followed by the decomposition of the polymer backbone at 350° to 500° C. In connection with the decomposition of the polymer backbone, the straight-chain portion is decomposed at 350° to 400° C., and the benzene ring portion is decomposed at 410° to 500° C. In the cation exchange resin, on the other hand, the sulfonic acid group as the ion exchange group is first decomposed at 200° to 300° C., followed by the decomposition of the polymer backbone in the same way as in the case of the anion exchange resin. These results are shown in Table 1.

TABLE 1

| | Structure | Decomposition temperature (°C.) |
|---|---|---|
| Ion exchange group | quaternary ammonium group (anion exchange resin) | 130~190 |
| | sulfonic acid group (cation exchange resin) | 200~300 |
| Polymer backbone | straight-chain portion | 350~400 |
| | benzene ring portion | 410~500 |

FIG. 2 shows the pyrolysis characteristics of the anion exchange resin, in which those in the inert atmosphere (nitrogen atmosphere) are represented by a solid line (a), and those in the oxidizing atmosphere (air atmosphere) by a broken line (b). Referring to Table 1, if the pyrolysis is carried out at 300° to 400° C. in the inert atmosphere, only the ion exchange group is decomposed, whereas both ion exchange group and polymer backbone are decomposed if the pyrolysis is carried out at 300° to 500° C. in the oxidizing atmosphere.

FIG. 3 shows the pyrolysis characteristics of the cation exchange resin, in which a solid line (a) represents the inert atmosphere (nitrogen atmosphere) and a broken line (b) the oxidizing atmosphere (air atmosphere). In the case of the cation exchange resin, too, only the ion exchange group is decomposed if the pyrolysis is carried out at 300° to 400° C. in the insert atmosphere, whereas both ion exchange group and polymer backbone are decomposed at 300° to 500° C. in the oxidizing atmosphere. The reason why only the ion exchange group is decomposed in the inert atmosphere is that the decomposition reaction of the ion exchange group is a thermal elimination reaction requiring no oxygen, whereas that of the polymer backbone is an oxidation reaction requiring oxygen.

On the basis of the results described above, the waste resin is first pyrolyzed at 300° to 400° C. in the inert atmosphere as the first stage reaction so as to selectively decompose only the ion exchange group of the ion exchange resin, and to generate sulfur and nitrogen contained only in the ion exchange group as sulfur compounds ($SO_x$, $H_2S$, etc.) and nitrogen compounds ($NO_x$, $NH_3$, etc.) at this stage. Careful exhaust gas processing must be carried out using an alkali scrubber or the like. Thus, the pyrolysis is carried out at 300° to 500° C. in the oxidizing atmosphere as the second stage reaction so as to completely decompose the polymer backbone consisting of carbon and hydrogen, whereby the residue drops to only several percents. The exhaust gases generated in this case are $CO_2$, $H_2$, $H_2O$, CO and the like, and hence hardly any particular exhaust gas processing is necessary.

When the waste resin is pyrolyzed at two stages of the inert atmosphere and the oxidizing atmosphere as described above, the exhaust gas processing becomes far easier than when the waste resin is pyrolyzed at a single stage.

When the waste resin is pyrolyzed again in the oxidizing atmosphere after the pyrolysis in the inert atmosphere, 0.074 $m^3$ sulfur and nitrogen compounds are generated only at the first stage, while none of them are generated and 1.34 $m^3$ of $CO_2$ and the like are generated at the second stage. Since the sulfur and nitrogen compounds, whose emission into the air is legally prohibited and for which exhaust gas processing such as desulfurization and denitrification is necessary, are generated in a limited quantity only at the first stage, the exhaust gas to be processed is only 0.074 $m^3$.

The waste resin is pyrolyzed over the two stages of the inert gas atmosphere and the oxidizing atmosphere in accordance with the present invention, the quantity of the exhaust gas, that requires careful exhaust processing, can be reduced to about 1/20.

(3) Scattering behavior of the radioactive substances etc. when the ion exchange resin is pyrolyzed.

Next, the scattering behavior of the radioactive substances and decomposition residue into the exhaust gas when the waste resin was pyrolyzed was studied. FIG. 4 shows an example of changes in the scattering ratio of the radioactive substances with the pyrolysis temperature. (velocity of flowing gas 1 cm/s). By the term "scattering ratio" is meant a value or quotient obtained by dividing the quantity of the radioactive substances scattered into the exhaust gas during pyrolysis by the quantity of the radioactive substances adsorbed by the ion exchange resin from the beginning. In the diagram, symbol C.P. represents corrosion product, and F.P. represents fission product.

$^{60}Co$ represented by solid line (a) exhibits a scattering ratio of below $10^{-3}$ % (detection limit) over the entire temperature range, and $^{137}Cs$ represented by broken line (b) exhibits a scattering ratio of up to $10^{-3}$ % at a temperature below 470° C. and 0.2% above 500° C. The scattering ratio of the residue is up to $10^{-3}$ % for both $^{60}Co$ and $^{137}Cs$ cover the entire temperature range. The reason why $^{137}Cs$ scatters at a temperature above 470° C. is that $^{137}Cs$ adsorbed by the ion exchange group is oxidized by oxygen in the air into $Cs_2O$ (m.p. 490° C.), and this compound is evaporated. In order to confirm this fact, the scattering ratios as shown Table 2 are studied also for other radioactive substances.

TABLE 2

| Radioactive nuclide | | Melting point of oxide (°C.) | Radioactive scattering starting temperature (°C.) |
|---|---|---|---|
| Corrosion product (C.P.) | $^{60}Co$ | 1,800 | >1,000 |
| | $^{54}Mn$ | 1,650 | |
| | $^{59}Fe$ | 1,370 | |
| | $^{51}Cr$ | 1,550 | |
| Fission product (F.P.) | $^{137}Cs$ | 490 | 470 |
| | $^{106}Ru$ | 400 | 420 |
| | $^{90}Sr$ | 2,400 | >1,000 |
| | $^{140}La$ | 2,000 | >1,000 |

It can be understood from the results described above that the scattering of the radioactive substances and decomposition residue into the exhaust gas can be restricted if the pyrolysis of the waste resin is carried out at a temperature below 420° C. This means that when the waste resin is pyrolyzed at the two stages of the inert atmosphere and the oxidizing atmosphere, the nitrogen and the sulfur compounds generated in the inert atmosphere can be regarded as the nonradioactive substance. This is because the pyrolysis temperature in the inert atmosphere is from 300° to 400° C. and the scattering of the radioactive substances and decomposition residue into the exhaust gas does not occur in this temperature range.

As a result, when the method of decomposing the waste resin by pyrolysis is employed, the content of either one, or both, of the nitrogen and the sulfur compounds in the resulting radioactive waste can be limited to a value far lower than 24 wt %. Of course, less fluidization of the atmosphere is preferred in order to minimize the scattering.

(4) Adding a catalyst to ion exchange resin.

Since the pyrolysis temperature in the oxidizing atmosphere is as high as from 300° to 500° C., there is a possibility that the radioactive substances and the decomposition residue might scatter at this stage. However, if the pyrolysis temperature is lowered to 420° C. in order to avoid this possibility, the waste resin can be pyrolyzed by only about 60% in terms of weight at the pyrolysis temperature of 420° C. as can be obviously understood from FIG. 1, so that the volume reduction ratio is only about ½. When a practical apparatus for decomposing the waste resin is taken into consideration, the temperature distribution exists inside the reaction vessel, and it is by no means rare that the temperature difference of as large as at least 50° C. exists between the portion of the highest temperature and that of the lowest temperature. Therefore, if the decomposition temperature at a part inside the reaction vessel is 350° C., for example, the decomposition ratio of the waste resin at that part is only about 40% by weight from FIG. 1.

In order to solve this problem, the inventors of the present invention have examined the advantage brought forth by a catalyst. The inventors of the present invention have paid specific attention to the property of the waste resin, that is, the ion exchange resin, and have succeeded in dispersing the catalyst into the waste resin by chemical means. First, an example of the case of the cation exchange resin will be described.

In this example, iron which is economical and is easy to handle is used as the catalyst. In order to utilize iron as the cation, ferric nitrate is dissolved in water to prepare $Fe^{3+}$ ion, and the cation exchange resin is dipped in the solution, whereby iron is taken up by the waste resin through ion exchange. The pyrolysis characteristics of the waste resin, when the iron catalyst is adsorbed by and dispersed into the resin in advance in the manner described above, are represented by a solid line (a) in FIG. 5. A broken line (b) in the diagram represents the case where no catalyst is added. As can be seen clearly from FIG. 5, if the iron catalyst is adsorbed in advance by the waste resin (cation exchange resin), the pyrolysis temperature can be lowered from 500° C. to 240° C.

The results of measurement of the pyrolysis temperatures when various metal catalysts are used in the same way are shown in Table 3.

TABLE 3

| Catalyst | | Decomposition temperature (°C.) |
|---|---|---|
| — | None | 500 |
| Transition metal | $Pt^{4+}$ | 240 |
| | $Pd^{2+}$ | 240 |
| | $Cu^{2+}$ | 270 |
| | $Fe^{2+}$, $Fe^{3+}$ | 290 |
| | $Mn^{2+}$ | 290 |
| | $Co^{2+}$ | 320 |
| | $Ni^{2+}$ | 310 |
| Alkali metal | $Na^{+}$ | 500 |
| | $Cs^{+}$ | 500 |
| Alkaline | $Ca^{2+}$ | 500 |

TABLE 3-continued

| Catalyst | Decomposition temperature (°C.) |
|---|---|
| earth metal | |

As can be seen clearly from Table 3, if the transition metal is adsorbed in advance by the cation exchange resin through ion exchange, the decomposition temperature can be lowered to a point at which the scattering of the radioacitve substances can be prevented. Among them, the iron catalyst is believed to be most practival because it is economical and does not provide any problem in its handling.

Next, the catalyst for the anion exchange resin will be described. Since the transition metal catalyst is cationic, it can not be adsorbed by the anion exchange resin. Therefore, the inventors of the present invention have paid specific attention to an anionic atom group containing a transition metal, that is, a metal complex ion, and have suceeded in adsorbing it by the anion exchange resin.

An example in which hexacyanoferric (III) acid is used as the anionic atom group will be described. The hexacyanoferric (III) acid is selected because it is an anion containing iron having the catalytic action and that it is economical. In order to allow the waste resin to adsorb hexacyanoferric (III) acid, potassium hexacyanoferrate (III) is dissolved in waster and ionized, and the waste resin is then dipped into the solution. The pyrolysis characteristics in this case are shown in FIG. 6. In the diagram, a solid line (a) represents this example, and a broken line (b) does the case where no catalyst is added. As is obvious from the diagram, this example can lower the pyrolysis temperature of the waste resin from 500° C. to 260° C.

Table 4 shows the results of measurement of the pyrolysis temperatures of the anion exchange resin when other anionic atom groups containing the transition metal are used as the catalyst.

TABLE 4

| Catalyst | Decomposition temperature (°C.) |
|---|---|
| none | 500 |
| $(Pt\ Cl_6)^{2-}$ | 240 |
| $(Pd\ Cl_4)^{2-}$ | 240 |
| $[Fe(CN)_6]^{4-}$, $[Fe(CN)_6]^{3-}$ | 260 |
| $Fe(C_2O_4)_3^{3-}$ | 260 |
| $MnO_4^-$ | 270 |
| $[Co(NO_2)_6]^{4-}$ | 290 |
| $[Ni(CN)_6]^{4-}$ | 290 |

It can be understood from Table 4 that when the anionic atom groups containing the transition metal are used as the catalyst, the decomposition temperature can be lowered in all cases. Among them, hexacyanoferric (III) acid $[Fe(CN)_6]^{4-}$ and permanganic acid $MnO_4^-$ can be said to be practical catalysts because they are economical and free from any toxicity.

The description given above may be summarized as follows.

The thermal decomposition temperature can be lowered from 500° C. to 300° C. or below by adsorbing the transition metal ion by the cation exchange resin and the anionic atom group containing the transition metal by the anion exchange resin prior to the pyrolysis. As a result, in comparison with the conventional fluidized bed process (decomposition temperature: 600° to 900° C.), the service life of the furnace material can be extended and the pyrolysis temperature of the waste resin in the oxidizing atmosphere by the above-described pyrolysis method can be limited to 420° C. or below. Therefore, the scattering of the volatile radioactive substances such as $^{137}Cs$ into the exhaust gas can be prevented, and the volume reduction ratio can be improved drastically.

The characterizing features of the present invention can be summarized as follows.

(1) The waste resin is pyrolyzed at the two stage of the inert atmosphere and the oxidizing atmosphere.

(2) The transition metal ion is adsorbed in advance by the cation exchange resin and the anionic atom group containing the transition metal is by the anion exchange resin, prior to the pyrolysis of the waste resin.

(3) The pyrolysis is carried out at a temperature ranging from 240° to 420° C.

DESCRIPTION OF THE PREFERRED EMBODIMENTS

Example 1

This example describes one embodiment of the present invention for processing the waste resin in which the pyrolysis of the waste resin and the solidification treatment of the decomposition residue are carried out in the same vessel.

Figure 1:
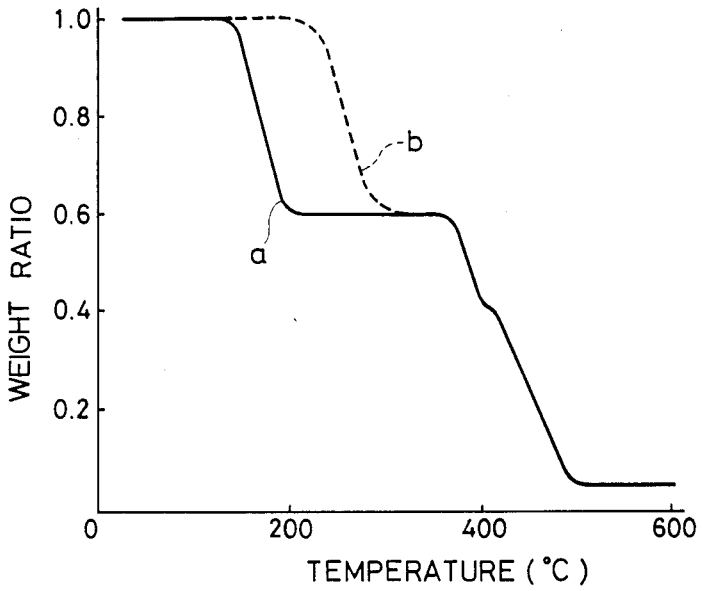
FIG. 1 is a diagram showing the pyrolysis characteristics of the waste resin in the air atmosphere.
Figure 2:
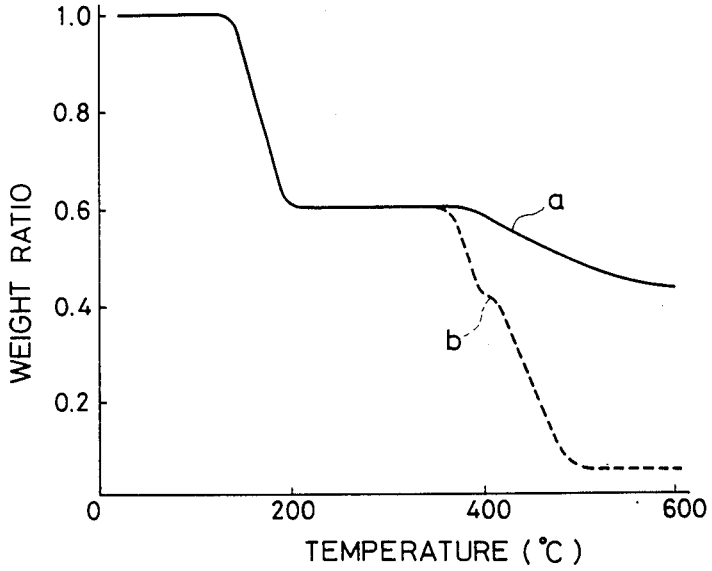
FIG. 2 is a diagram showing the pyrolysis characteristics of an anion exchange resin in the nitrogen atmosphere and in the air atmosphere.
Figure 3:
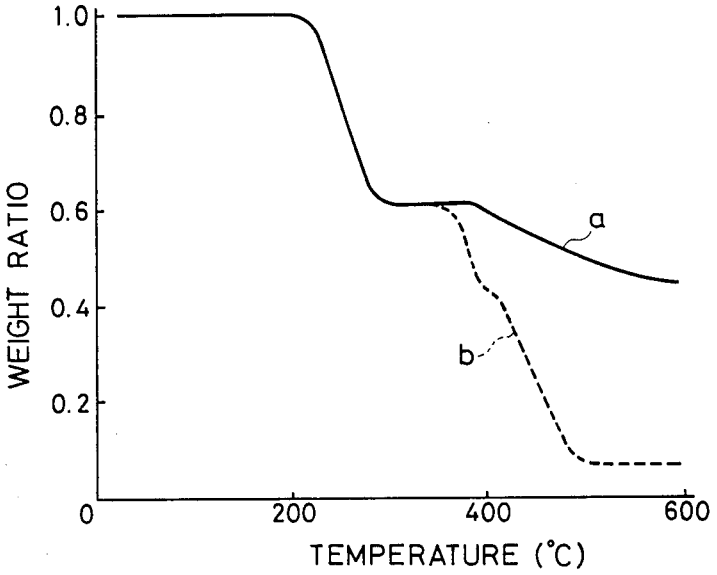
FIG. 3 is a diagram showing the pyrolysis characteristics of a cation exchange resin in the nitrogen atmosphere and in the air atmosphere.
Figure 4:
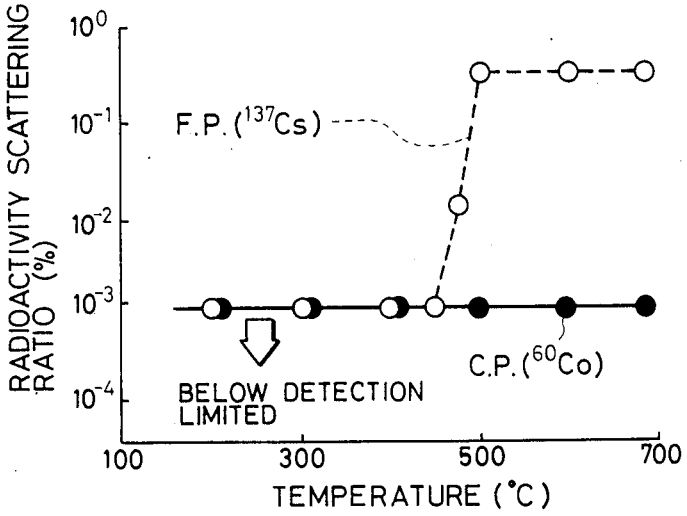
FIG. 4 is a diagram showing the temperature dependence of the scattering ratio of the radioactive substance when the waste resin is pyrolyzed.
Figure 5:
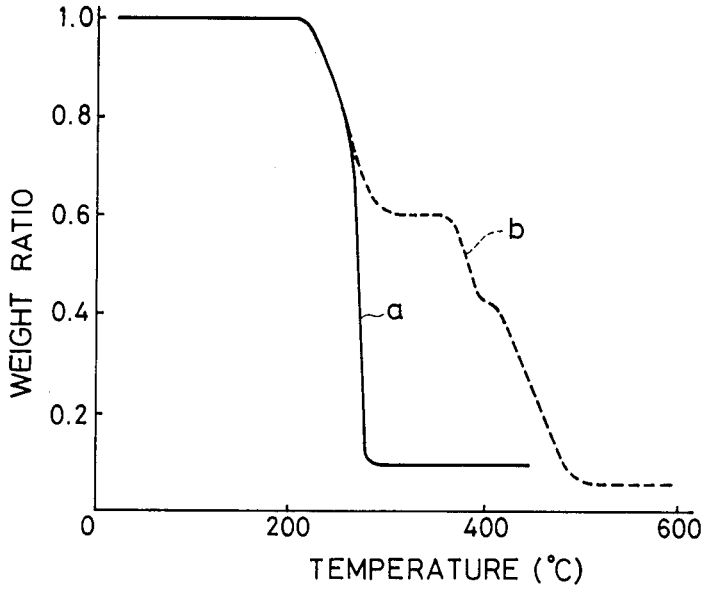
FIG. 5 is a diagram showing the pyrolysis characteristics of a cation exchange resin when iron is ionically adsorbed.
Figure 6:
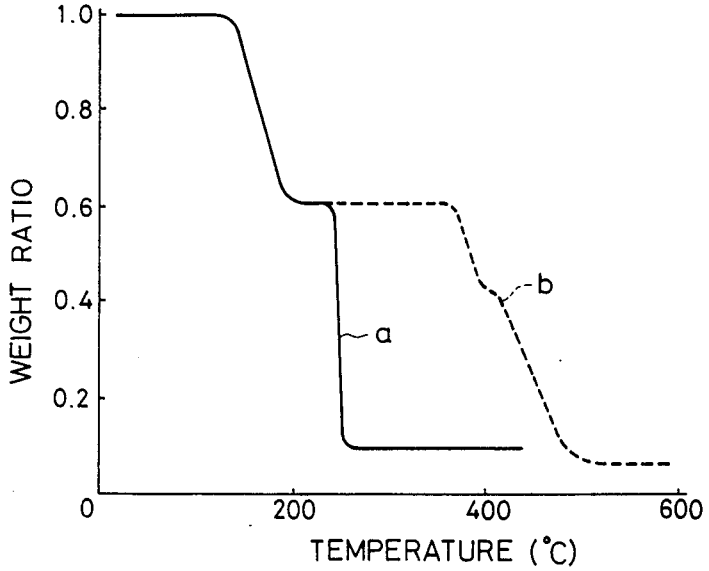
FIG. 6 is a diagram showing the pyrolysis characteristics of an anion exchange resin when hexacyanoferric (III) acid is ionically adsorbed.
Figure 7:
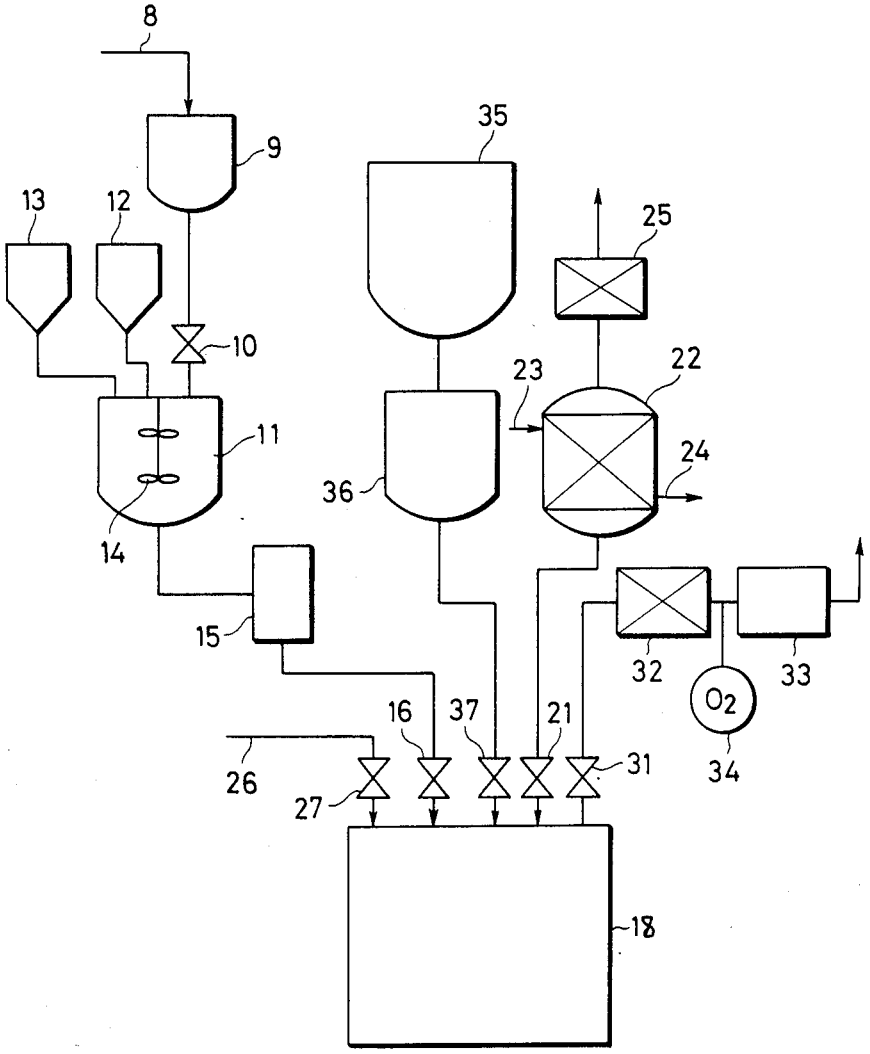
FIG. 7 is a system diagram of one embodiment of the present invention.
Figure 8:
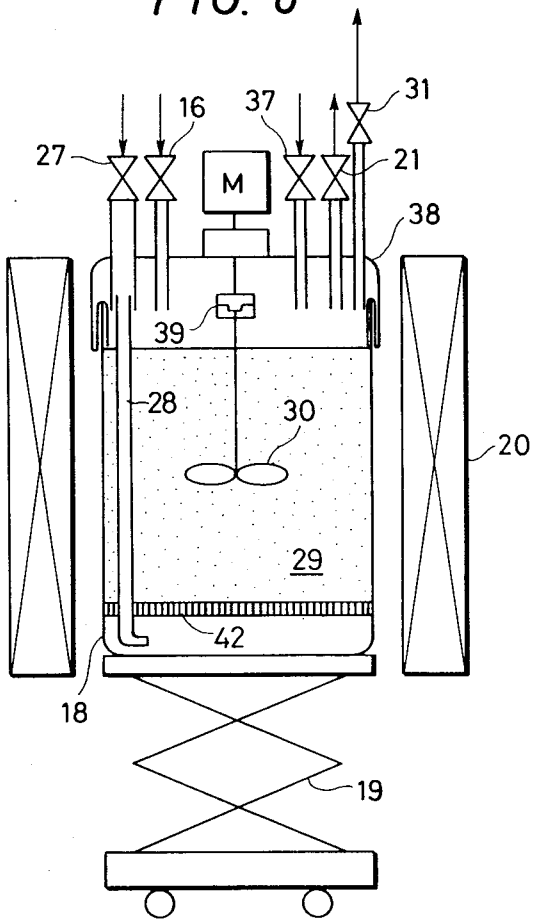
FIG. 8 is a detailed view of the reaction vessel in one embodiment of the present invention.

FIG. 7 shows a system diagram for pyrolyzing the waste resin generated from a reactor water purification system of a pressurized water reactor so as to reduce the volume and to convert the waste resin into inorganic matters, and FIG. 8 shows in detail the reaction vessel/-solidification vessel among the system.

The waste resin was discharged from a condensation desalting device by backwash, and was in the slurry form. This waste resin slurry was supplied from a slurry transportation pipe 8 into a waste resin reservoir 9. The waste resin contained 10 μCi/g (dry basis) of corrosion products such as $^{60}Co$, $^{54}Mn$ and the like as the radioactive nuclides and 10 μCi/g (dry basis) of fission products such as $^{137}Cs$, $^{90}Sr$, $^{106}Ru$ and the like. It was a 2:1 mixture of the cation exchange resin and the anion exchange resin.

The waste resin from the reservoir 9 was transferred in a predetermined quantity (30 kg on a dry basis) through a valve into an adjustment tank 11.2 mol of $FeCl_2$ and 1 mol of $Ke[Fe(CN)_6]$ were added thereto from a cationic catalyst reservoir 12 and an anionic catalyst reservoir 13, respectively, and the mixture was stirred by agitation vanes 14 inside the adjustment tank 11 for about one hour.

The waste resin was centrifuged and dehydrated in a dehydrator 15, and was supplied into a reaction vessel 18 (see FIG. 8) placed in a hermetically sealed reaction apparatus 17 through a valve 16.

The fixed bed type reaction vessel 18 was made of SUS304 stainless steel and had an inner capacity of 100 l and a diameter of 500 mm. The reaction vessel 18 was mounted at this stage on a movable lifter 19 so that it could be packed into a drum after the waste resin was pyrolyzed and solidified. An induction heating system applying an a.c. voltage to a primary coil 20 and inducing an excitation current on the surface of the reaction vessel 18 for heating was employed as the heating means for the reaction vessel 18. This was because the system facilitated uniform heating, in which the temperature could be controlled to 350°±20° C.

The waste resin 29 fed to the reaction vessel 18 was heated to 350° C. and was pyrolyzed in the vessel without supplying any oxygen and air as the oxidizing agent from outside but using confined air as the inert atmosphere. (The oxygen of confined air exhausted with the start of the pyrolysis reaction and became rapidly inert). As a result, only the ion exchange group of the waste resin 29 was decomposed, generating about 2.5 $m^3$ of sulfur compounds ($SO_x$, $H_2S$, etc.) and nitrogen compounds ($NO_x$, $NH_3$, etc.) in the gaseous form.

These exhaust gases were guided into an alkali scrubber 22 of an exhaust gas processing apparatus through a valve 21, and were converted aqueous solutions of sodium salts ($Na_2$ SO4, $NaNO_3$, etc.) by an aqueous sodium hydroxide solution supplied from supply pipe 23. Thereafter, they were discharged outside the system through a discharge pipe 24.

Since these aqueous solutions were non-radioactive, they could be processed by a processing step for a liquid non-radioactive chemical waste of a nuclear power plant. When the aqueous solutions (liquid waste) were dried and processed, the resulting solid matters ($Na_2SO_4$ and the like) had a radioactivity of up to $10^{-6}$ $\mu$Ci/g, and these secondary wastes such as $Na_2SO_4$ could be handled as the non-radioactive wastes. This suggested also that the decontamination coefficient was at least $10^7$ and these secondary wastes were non-radioactive. A considerable quantity of exhaust gas after being processed by the alkali scrubber 22 was discharged through a filter 25.

After only the ion exchange group was decomposed and separated in the reaction vessel 18 in the course of about one hour, the waste resin (only the polymer backbone) was pyrolyzed in the same vessel 18 at the same temperature (350° C.) but in the oxidizing atmosphere. That is to say, the air as the oxidizing agent was supplied from a cylinder or an air compressor to the waste resin 29 in the reaction vessel 18 through a supply pipe 26, a valve 27 and another supply pipe 28. The air flow rate was 20 $m^3$/h The air thus supplied was dispersed by a porous plate 42 made of SUS stainless steel, and flew inside the waste resin 29 at a uniform velocity (3 cm/s). A stirrer 30 was provided in the reaction vessel 18 to further disperse the air and to make uniform the inner temperature of the reaction vessel.

When the pyrolysis was continued for about eight hours in the oxidizing atmosphere, the polymer backbone was completely decomposed, and only about 1.7 kg of stable residue remained. The volume reduction ratio was about 1/18.

In the meantime, about 50 $m^3$ of $CO_2$, CO, $H_2$ and the like were generated. These exhaust gases were passed through a valve 31 and a filter 32, and then entered a flare stack 33, where they were burnt and were discharged as $CO_2$ and $H_2O$ gases. Though the radioactivity in the exhaust gas and that of the filter 32 were measured, they were below the detection limit, and the decontamination coefficient in the pyrolysis of the polymer backbone was at least $10^6$ and these secondary wastes were non-radioactive. Only up to 1 g (detection limit) of the residue was collected by the filter 32, and it was thus confirmed that the load onto the filter was remarkably reduced.

In order to mechanically detect the termination of the pyrolysis of the waste resin, an $O_2$ sensor 34 was fitted to this exhaust gas processing system, and the time till the end of the pyrolysis was monitored.

Next, solidification with cement glass was effected in the same reaction vessel 18 where only the residue remained after the end of the decomposition. After adjusting the properties of the solidifying agent (cement glass of silicic acid alkali composite) to predetermined values in a solidifying agent tank 35, the solidifying agent was supplied into a solidifying agent measuring tank 36. A predetermined quantity of cement glass was supplied from this tank 36 into the reaction vessel 18 through a valve 37 to solidify the pyrolysis residue of the waste resin.

When conducting this solidification, an agitation vanes 30, a porous plate 42 and an air supply pipe 28 in the reaction vessel 18 were also solidified together with the decomposition residue because they were so-called "radioactive solid wastes" that were contaminated with the radioactivity. The reaction vessel 18 and its lid portion 38 could be easily fitted and removed mechanically in consideration of the transportation of the reaction vessel 18 after the solidification. In other words, a removal mechanism 39 was disposed on the air supply pipe 28 and the shaft portion of the stirrer so that the lid 38 and the reaction vessel 18 were cut off from each other by separating this mechanism portion when the reaction vessel 18 was pulled down by the movable lifter 19 after the end of the solidification. Therefore, the lid 38 had a structure that could withstand the repeated use. A hermetically sealed structure was employed in order to keep completely air-tight the contact portion between the lid 38 and the reaction vessel 18 during the pyrolysis as well as solidification.

After the decomposition residue was solidified in the manner described above, the residue was transferred while kept in the reaction vessel 18 by the movable lifter 19 to a drum filling facility.

As described above, since the atmosphere during the pyrolysis was divided into the two stages of the inert atmosphere and the oxidizing atmosphere, the quantity of the exhaust gases to be processed could be reduced remarkably, and the content of the nitrogen and sulfur compounds in the radioactive waste could be reduced to below 24 wt %.

Since the catalyst was adsorbed in advance by the waste resin, the pyrolysis of the waste resin could be made at 350° C. Therefore, not only the service life of the reaction vessel 18 could be prolonged, but also the scattering of the volatile radioactive substances such as $^{137}Cs$ into the exhaust gases could be prevented due additionally to the fact that the atmosphere was a heremetically sealed static atmosphere or an atmosphere close to that.

The system could be operated easily because the pyrolysis and the solidification of the decomposition residue were continuously made in the same reaction vessel, and the exposure of the workers could be reduced.

In this example, no gases were supplied at all from outside when only the ion exchange group was decomposed, and the confined air was used as the inert atmosphere. However, it is of course possible to cause an inert gas such as nitrogen or argon to flow in from outside at a low velocity.

In this example, the air was caused to flow as the oxidizing agent when the polymer backbone was decomposed, but oxygen could be caused to flow, too. In such a case, if oxygen is supplied at the same velocity as the air, the time required for the pyrolysis can be reduced to 1/5 at the maximum.

In the example, though the exhaust gases generated during the decomposition of the ion exchange group were processed by wet-processing using the alkali scrubber 22, substantially the same effect could be obtained by dry-processing using active carbon, MnO or the like.

Though the pyrolysis in the inert atmosphere and that in the oxidizing atmosphere were carried out in the same reaction vessel in this example, it is also possible to effect the pyrolysis by using two separate reaction vessels.

Though the pyrolysis temperature in the inert atmosphere and in the oxidizing atmosphere were the same in this example, the temperatures in these atmospheres may be different from each other.

Furthermore, though a stainless steel was used here for the porous plate 42 inside the reaction vessel 18, it is also possible to use a porous plate made of ceramics.

Though cement glass was used here as the solidifying agent, other solidifying agents, thermal hardening plastics etc. for example, can also be used.

Example 2

Though the reaction vessel 18 of a fixed bed type shown in FIG. 8 of Example 1 has an advantage that the waste resin can be continuously processed, it is not suitable for precisely changing over the atmosphere in the reaction vessel into the inert atmosphere at the first stage and into the oxidizing atmosphere at the second stage. Therefore, the reaction vessel of this type has a likehood that those gases which require careful exhaust gas processing, such as $SO_x$, $NO_x$ and the like, can not be strictly separated from those which do not require careful exhaust gas processing, such as $CO_2$, $H_2$, $H_2O$ and the like.

Figure 9:
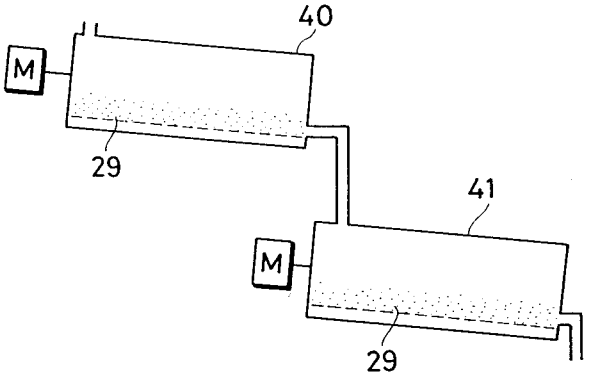
FIG. 9 shows a rotary kiln type reaction vessel in another embodiment of the present invention.

It is therefore possible, in principle, to use moving bed type two reaction vessels so that the pyrolysis can be effected in the inert gas atmosphere by using the first reaction vessel and in the oxidizing atmosphere by using the second reaction vessel, and exhaust gases generated from these reaction vessels can be separated from one another. This example is based upon this concept. In this example, the waste resin 29 was pyrolyzed at 350° in the inert atmosphere using a rotary kiln 40 as the first reaction vessel to decompose only the ion exchange group, and the polymer backbone was decomposed at 350° C. in the oxidizing atmosphere in another rotary kiln 41 as the second reaction vessel, as shown in FIG. 9.

The objects of the invention described earlier could be accomplished by this example, too. Thus, a moving bed reaction vessel is also effective as a reaction vessel for practising the present invention.

Example 3

This example is one wherein a reaction vessel made of concrete used was as the reaction vessel. The reaction vessel provided substantially the same effect as the one made of stainless steel. An electric heater was used as heating means for the concrete vessel. The concrete vessel containing no aggregate was used. When the pyrolysis was carried out in the same way as in Example 1, no change could be observed in particular in the concrete vessel, and decomposition of the waste resin was found excellent. The concrete reaction vessel could be used because the decomposition temperature of the waste resin could be drastically lowered as described already.

Example 4

Among the radioactive substances, those which have high volatility are $^{106}Ru$ (scattering starting temperature: 420° C.) and $^{137}Cs$ (scattering starting temperature: 470° C.) as shown in Table 2. Among them, $^{106}Ru$ has a half life of as short as about one year.

Therefore, this example was conducted to store the waste resin in a waste resin reservoir for about 10 years and then to carry out the pyrolysis of the waste resin after the waste resin is completely decayed. In this case, $^{137}Cs$ whose half life is about 30 years hardly decays but remains as such, but in comparison with the case where $^{106}Ru$ exists, it is possible to regard that the scattering starting temperature of the radioactive substances into the exhaust gas changes substantially from 420° C. to 470° C. Therefore, even if the temperature distribution inside the reaction vessel is somewhat non-uniform and the waste resin temperature is locally at 450° C. though the reaction temperature is controlled to 350° C., for example, the scattering of the radioactive substances into the exhaust gases can be prevented.

In this manner, there can be obtained the advantage that the temperature control inside the reaction vessel becomes easier by allowing $^{106}Ru$ to decay. Furthermore, since the radioactivity of the waste resin as a whole is decreased, handling of the waste resin naturally becomes easier so much.

Example 5

Though the transition metal as the catalyst was ionically adsorbed by the waste resin and then the waste resin was pyrolyzed in the foregoing Example 1, substantially the same result can be obtained in the pyrolysis in the inert atmosphere, even when no catalyst is added.

In this Example 5, only the ion exchange group of the waste resin, that generates the nitrogen and sulfur compounds in the radioactive waste, was pyrolyzed at 350° C. in the inert atmosphere without adding any catalyst. As a result, it was confirmed that the ion exchange group could be sufficiently decomposed under the condition described above, even if no catalyst was added to the waste resin. The radioactivity of the exhaust gases in this case was below the detection limit. Next, only the polymer backbone in waste resin was pyrolyzed at the temperature 350° C. in the oxidizing atmosphere adding a catalyst.

As described above, when the waste resin to which no catalyst was added and which was in an anhydrous state was pyrolyzed at 350° C. in the inert atmosphere, the content of the nitrogen and sulfur compounds in the radioactive waste could be restricted on an extremely low value of below 24 wt %.

What is claimed is:

1. A method of processing spent ion exchange resin comprising:

(a) a step of adding a catalyst to said spent ion exchange resin wherein a transition metal is adsorbed in advance as a catalyst through ion exchange by the spent ion exchange resin when the ion exchange resin is a spent cation exchange resin, and an anionic atom group containing a transition metal is absorbed in advance as a catalyst through ion exchange by the ion exchange resin when the ion exchange resin is a spent anion exchange resin;

(b) a first separating step of pyrolyzing the catalyst containing spent ion exchange resin in an inert atmosphere wherein the ion exchange group of the catalyst containing spent ion exchange resin is decomposed and sulfur oxide and nitrogen oxide gases are separated; and (c) a second separating step of pyrolyzing the catalyst containing spent ion exchange resin, which has passed through said first separating step, in an oxidizing atmosphere wherein the polymer backbone of the catalyst containing spent ion exchange resin is decomposed and carbon dioxide and water gases are separated from the spent ion exchange resin residue.

2. A method of processing spent ion exchange resin as defined in claim 1 wherein said transition metal to be adsorbed by said spent cation exchange resin is a transition metal of the Group VIII of the Periodic Table represented by platinum, palladium and iron, or a transition metal of the Group I of the Periodic Table represented by copper.

3. A method of processing spent ion exchange resin as defined in claim 1 wherein said anionic atom group containing said transition metal is one containing a transition metal of the Group VIII of the Periodic Table represented by chloroplatinic acid, chloropalladic acid and hexacyanoferric (III) acid, or one containing a transition metal of the Group VIII of the Periodic Table represented by permanganic acid.

4. A method of processing spent ion exchange resin as defined in claim 1 wherein the pyrolysis in both of said first and second separating steps is carried out at a temperature in range of from 240° to 420° C.

5. A method of processing spent ion exchange resin as defined in claim 1 wherein said ion exchange resin processed is a radioactive spent ion exchange resin.

6. A method of processing radioactive spent ion exchange resin as defined in claim 5 further including a fourth step of adding a cement glass of silicic acid alkali composite to solidify the pyrolysis residue of the radioactive waste resin.

7. A method of processing radioactive spent ion exchange resin as defined in claim 5 wherein the pyrolysis in both of said first and second separating step is carried out at a temperature in range of from 240° to 420° C.

8. A method of processing spent ion exchange resin comprising:

a first separating step of pyrolyzing a spent ion exchange resin in an inert atmosphere wherein the ion exchange group of said spent ion exchange resin is decomposed and sulfur oxide and nitrogen oxide gases are separated; and second separating step of pyrolyzing said spent ion exchange resin, which has passed through said first separating step, in an oxidizing atmosphere wherein the polymer backbone of said spent ion exchange resin is decomposed and carbon dioxide and water gases are separated from the spent ion exchange resin residue.

9. A method of processing spent ion exchange resin as defined in claim 8 wherein the pyrolysis in both of said first and second separating steps is carried out at a temperature in range of from 240° to 420° C.

10. A method of processing spent ion exchange resin as defined in claim 8 wherein said ion exchange resin processed is a radioactive spent ion exchange resin.

11. A method of processing radioactive spent ion exchang resin as defined in claim 10 further including a third step of adding a cement glass of silicic acid alkali composite to solidify the pyrolysis residue of the radioactive waste resin.

12. A method of processing radioactive spent ion exchange resin as defined in claim 10 wherein the pyrolysis in both of said first and second separating step is carried out at a temperature in range of from 240° to 420° C.

13. A method of processing spent ion exchange resin comprising: a step of adding catalyst wherein a transition metal is adsorbed in advance as a catalyst through ion exchange by said spent ion exchange resin when said spent ion exchange resin is spent cation exchange resin, and an anionic atom group containing a transition metal is adsorbed in advance as a catalyst through ion exchange by said spent ion exchange resin when said spent ion exchange resin is spent anion exchange resin; first separating step of pyrolyzing said spent ion exchange resin in an inert atmosphere at a temperature in range of from 240° to 420° C. and separating sulfur oxide and nitrogen oxide gases generated during pyrolysis; and second separating step of pyrolyzing said spent ion exchange resin in an oxidizing atmosphere at a temperature in range of from 240° to 420° C. and separating carbon dioxide and water gases generated during pyrolysis.

14. A method of processing radioactive spent ion exchange resin comprising: a step of adding a catalyst wherein a transition metal is adsorbed in advance as a catalyst through ion exchange by said spent ion exchange resin when said radioactive spent ion exchange resin is radioactive spent cation exchange resin, and an anionic atom group containing a transition metal is adsorbed in advance as a catalyst through ion exchange by said radioactive spent ion exchange resin when said radioactive spent ion exchange resin is radioactive spent anion exchange resin; first separating step of pyrolyzing said radioactive spent ion exchange resin in an inert atmosphere at a temperature in range of from 240° to 420° C. and separating sulfur oxide and nitrogen oxide gases generated during pyrolysis; and second separating step of pyrolyzing said radioactive spent ion exchange resin in an oxidizing atmosphere at a temperature in range of from 240° to 420° C. and separating carbon dioxide and water vapor gases generated during pyrolysis.

15. A method of processing radioactive spent ion exchange resin as defined in claim 14 wherein a transistion metal of the Group VIII of the Periodic Table represented by platunum, palladium and iron, or a transition metal of the Group I of the Periodic Table represented by copper, is adsorbed in advance to both separating steps as a catalyst through ion exchange when said spent ion exchange resin is a spent cation exchange resin, and an anionic atom group containing a transition metal of the Group VIII of the Periodic Table represented by chloroplatinic acid, chloropalladic acid and hexacyanoferric (III) acid or a transition metal of the Group VIII of the Periodic Table represented by permanganic acid is adsorbed in advance to both separating steps as a catalyst through ion exchange by said spent ion exchange resin when said spent ion exchange resin is a spent anion exchange resin.

* * * * *